US008016951B2

(12) United States Patent
Arai et al.

(10) Patent No.: US 8,016,951 B2
(45) Date of Patent: Sep. 13, 2011

(54) LOW CORE LOSS GRAIN-ORIENTED ELECTRICAL STEEL SHEET AND METHOD FOR PRODUCING THE SAME

(75) Inventors: Satoshi Arai, Hyogo (JP); Hideyuki Hamamura, Chiba (JP); Tatsuhiko Sakai, Chiba (JP); Kaoru Sato, Hyogo (JP); Hideyuki Kobayashi, Hyogo (JP)

(73) Assignee: Nippon Steel Corporation, Tokyo (JP)

( * ) Notice: Subject to any disclaimer, the term of this patent is extended or adjusted under 35 U.S.C. 154(b) by 575 days.

(21) Appl. No.: 11/919,580

(22) PCT Filed: Apr. 26, 2006

(86) PCT No.: PCT/JP2006/309187

§ 371 (c)(1), (2), (4) Date: Oct. 30, 2007

(87) PCT Pub. No.: WO2006/120985

PCT Pub. Date: Nov. 16, 2006

(65) Prior Publication Data

US 2009/0145526 A1 Jun. 11, 2009

(30) Foreign Application Priority Data

May 9, 2005 (JP) ..... 2005-135763
May 25, 2005 (JP) ..... 2005-152218

(51) Int. Cl.
*H01F 1/16* (2006.01)
*H01F 1/14* (2006.01)

(52) U.S. Cl. ..... 148/308; 148/306; 148/111; 148/120

(58) Field of Classification Search ..... None
See application file for complete search history.

(56) References Cited

U.S. PATENT DOCUMENTS 3,647,575 A 3/1972 Fiedler et al.
4,203,784 A 5/1980 Kuroki et al.
(Continued)

FOREIGN PATENT DOCUMENTS

EP 0897016 A1 2/1999
(Continued)

OTHER PUBLICATIONS

Korean Office Action Issued in the corresponding Korean patent application No. 10-2007-7028576 with English translation.

(Continued)

*Primary Examiner* — John P Sheehan
(74) *Attorney, Agent, or Firm* — Birch, Stewart, Kolasch & Birch, LLP

(57) ABSTRACT

An object of the present invention is to provide a grain-oriented electrical steel sheet with low core loss and low magnetostriction and a method for producing the same. The grain-oriented electrical steel sheet is excellent in reduced core loss and magnetostriction while under a high flux density of 1.9 T, comprises a refined magnetic domain comprising a laser irradiated portion which has melted and resolidified to form a solidified layer, wherein the thickness of the solidified layer is 4 μm or less. The grain-oriented electrical steel sheet may further comprise a laser irradiated portion where a surface roughness Rz is small and a cross section viewed from a transverse direction has a concave portion having a width of 200 μm or less and a depth of 10 μm or less for further improvement.

12 Claims, 2 Drawing Sheets

U.S. PATENT DOCUMENTS

| | | | | |
|---|---|---|---|---|
| 4,293,350 | A | 10/1981 | Ichiyama et al. | |
| 4,772,338 | A | 9/1988 | Fukuda et al. | |
| 4,846,448 | A | 7/1989 | Fukuda et al. | |
| 6,368,424 | B1 | 4/2002 | Sakai et al. | |
| 6,666,929 | B1 | 12/2003 | Ban et al. | |
| 7,045,025 | B2 * | 5/2006 | Hamamura et al. | 148/308 |
| 2001/0032684 | A1 | 10/2001 | Sakai et al. | |
| 2004/0040629 | A1 | 3/2004 | Hamamura et al. | |
| 2006/0169362 | A1 * | 8/2006 | Sakai et al. | 148/110 |

FOREIGN PATENT DOCUMENTS

| | | | |
|---|---|---|---|
| EP | 1149924 | A2 | 10/2001 |
| EP | 1367140 | A1 | 12/2003 |
| EP | 1 607 487 | A1 | 12/2005 |
| JP | 47-28419 | A | 11/1972 |
| JP | 48-83329 | A | 11/1973 |
| JP | 56-40123 | A | 4/1981 |
| JP | 56-116832 | A | 9/1981 |
| JP | 57-002252 | B2 | 1/1982 |
| JP | 58-005968 | B2 | 2/1983 |
| JP | 62-096617 | A | 5/1987 |
| JP | 53-83227 | A | 4/1988 |
| JP | 06-212275 | B | 8/1994 |
| JP | 2647322 | B2 | 5/1997 |
| JP | 2000-108861 | A | 4/2000 |
| JP | 2003-311459 | A | 11/2003 |
| JP | 2005-059014 | A | 3/2005 |
| WO | WO-2004/083465 | A1 | 9/2004 |

OTHER PUBLICATIONS

Yamamoto et al.; IEEE Transactions on Magnets; Sep. 1972; pp. 677-681.

Fujikura et al.; The Journal of the Magnetic Society of Japan, vol. 25, No. 4-2; 2001; pp. 895-898.

Arai et al.; The Journal of the Magnetic Society of Japan; vol. 25, No. 12; pp. 1612-1618, 2001.

G. C. Rauch et al.; Effect of beam dwell time on surface changes during laser scribing; Journal of Applied Physics, 57(1), 1985, pp. 4209-4211.

Hiroshi Suzuki et al.; Mechanism of Magnetic Domain Refinement on Grain-Oriented Silicon Steel by Laser Irradiation; Journal of the Society of Materials Science, Japan: 51(7): 2002; pp. 730-735 (Abstract and figures are provided in English).

Japanese Office Action dated Apr. 26, 2011, issued in corresponding Japanese patent application No. 2006-121576 (with English translation).

* cited by examiner

PHOTO (a)
SAMPLE OF INVENTION

PHOTO (b)
SAMPLE OF COMPARISON

LOW CORE LOSS GRAIN-ORIENTED ELECTRICAL STEEL SHEET AND METHOD FOR PRODUCING THE SAME

This application claims priority under 35 U.S.C. §119(a) to Application Serial Nos. 2005-135763 and 2005-152218 filed in Japan on May 9, 2005 and May 25, 2005, respectively, both of which are herein incorporated by reference in their entirety.

BACKGROUND OF THE INVENTION

1. Field of the Invention

This invention relates to a technology for reducing core loss in grain-oriented electrical steel sheet used for a static inductometer such as a transformer.

2. Description of the Related Art

Grain-oriented electrical steel sheet is mainly used for a static inductometer such as an electrical transformer. Required properties for the grain-oriented electrical steel sheets are: (1) low power loss during magnetization in an alternating current field, i.e. low core loss, (2) permeability is high in the range for the induction used for the machinery and devices and the sheet is easily magnetized, and (3) magnetostriction which causes noise is small. Especially, the requirement (1) is one of the most important factors of the transformer for evaluating its T.O.C. (Total Owning Cost) which is a measure of cost performance of transformer, since the power loss over time for a transformer continues for a long period from its installation to scrapping.

In order to reduce the core loss of grain-oriented electrical steel sheets, there have been developed many improvements such as: (1) increasing the intensity of (110)[001] orientation which is known as the Goss orientation, (2) increasing the content of solid solution elements such as Si which increases the electrical resistance, (3) decreasing the sheet thickness, (4) coating a ceramic film or insulation film onto the sheet in order to impart surface tension thereto, and (5) decreasing the size of grains. There are, however, limitations in the improvements by these metallurgical approaches, and other ways of reducing core loss have been sought.

As disclosed in U.S. Pat. No. 3,647,575, to Fieldler et al., a method was proposed to reduce core loss by refining the magnetic domains by imparting grooves to the surface of electrical steel sheets with a cutter. The grain-oriented electrical steel sheets have rectangular slab-shaped magnetic domains each of which adjoins another domain having the opposite magnetic polarity (hereinafter the magnetic domain is referred to simply as "domain"). A grain-oriented electrical steel sheet is magnetized as a result of expansion or shrinkage of each of the domains caused by an applied magnetic field. Thus, when the grain-oriented electrical steel sheet is magnetized, magnetization changes occur only at the neighborhood of the domain boundaries (domain walls) between adjoining domains. With this change, an eddy current generates in the steel sheet to cause eddy current loss which accounts for 60% to 70% of the core loss. The eddy current loss is in proportion to the square of the eddy current and is also in proportion to the movement speed of the domain wall. If each of the domains is refined to a small size, the number of portions where the eddy current occurs increases. However, since the movement speed of the domain wall decreases in inverse proportion to the width of the domain, the eddy current loss as a whole decreases almost in proportion to the width of the domain.

Various inventions are proposed in order to make this domain refinement technology industrially applicable. JP S58-5968B discloses a method to provide strained portions without making scratches on the surface of an electrical steel sheet by pressing and rolling small balls of 0.2 to 10 mm in diameter on the surface of an electrical steel sheet. JP S57-2252B discloses a method to provide an electrical steel sheet with small plastic strained portions by irradiating a laser beam on the surface of an electrical steel sheet in the transverse direction. JP S62-96617A discloses a method to provide an electrical steel sheet with small plastic strains by focusing plasma flame on the surface of the electrical steel sheet lineally in the transverse direction. These methods are based on domain refining technology which utilizes a domain which is stabilized with magnetized component in the direction perpendicular to the rolling direction, as a result of reciprocal effect (reverse mechanism) of magnetostriction, by small plastic strains introduced onto the electrical steel sheet. Especially, the grain-oriented electrical steel sheet of which domain is refined with laser irradiation (hereinafter referred to as "laser-domain-refined grain-oriented electrical steel sheet") is widely used in industry for a large-sized lamination type power transformer for which low core loss is required. The demands for such electrical steel sheets have increased tremendously in recent years because of the global trends for the reduction of energy consumption aiming at $CO_2$ output reduction.

However, the technology disclosed in the above-mentioned JP S58-5968B uses only mechanical strain, which may fail to bring a great reduction of core loss and make it difficult to apply the technology industrially because the technology requires pressing and rolling small balls in the transverse direction. The technology disclosed in the above-mentioned JP S57-2252B can reduce core loss well, however, further improvement is required for reducing magnetostriction. In the technology disclosed in above-mentioned JP S62-96617A, it is difficult to control the amount of strain, and thus there remains a problem in obtaining stably reduced core loss.

JP 2647322B discloses a method to produce a low core loss grain-oriented electrical steel sheet where an electrical steel sheet is melted by laser beam irradiation in the form of a line and re-solidified, the re-solidified portion is 50 to 300 μm in width, 5 to 35% of the sheet thickness in depth and is located in a direction ranging within ±15 degrees from the direction perpendicular to the rolling direction, and the interval between adjoining lines is 5 to 30 mm. Then the sheet is finally coated with an insulating film for imparting tension. This technology, however, is intended for the use in small wound-core type transformers which are stress relief annealed, and if the technology is used in large sheared-flat-lamination type transformers which are not stress relief annealed, the introduced excess strain makes it difficult to stably obtain an electrical steel sheet having the properties of low core loss as well as low magnetostriction and may even reduce the core loss.

Static inductometers such as transformers and reactors make noise when the core is magnetized by an alternating current field. The noise reduction is strongly demanded, since the number of transformers installed in urban areas is increasing according to the increase in demand for electricity. In addition, there is the trend of minimizing environmental impact. The noise is usually caused by the following; i.e., the vibration between the induction coils induced by electromagnetic force, the vibration in the joints of the core and between laminations induced by magnetic force, and the vibration of magnetostriction of electrical steel sheets.

Among these sources of noise, the noise from the core material can be reduced by the methods described below, for example: (1) the core is designed to work at a lower magnetic flux density because of a lower magnetostriction at low magnetic flux density of the electrical steel; (2) highly grain-oriented electrical steel is used so as to reduce the magnetostriction and the tension of the surface coating film on the electrical steel sheet is increased as disclosed in IEEE Transaction, MAG-8 (1972), p. 677-681, "Magnetic Properties of Grain-Oriented Silicon Steel with High Permeability Oriented Core HI-B", T. Yamamoto et al.; (3) specific arrangements for uniformly pinching the core is made as described in JP S47-28419A; (4) the core is covered with a sound isolation box as described in JP S48-83329A; and/or (5) the transformer is placed on a rubber cushion as described in JP S56-40123A.

These methods, however, are very costly because these methods require extra equipment to be added to transformer.

As reported in the Journal Of The Magnetic Society of Japan, Vol. 25, No. 4-2, 2001, the property of the magnetostriction with "laser-domain-refined grain-oriented electrical steel sheet" varies according to the conditions used for laser irradiation. More specifically, the property of the magnetostriction varies as the irradiation energy density of the laser Ua varies, therefore, the magnetostriction of the electrical steel sheet can be reduced by selecting relevant Ua value. With the method mentioned above, however, it is difficult to obtain the maximum effects regarding the reduction of magnetostriction.

As mentioned above, although the grain-oriented electrical steel sheet has been greatly improved with respect to core loss, still further improvement is demanded in view of increased energy consumption, increased concern about the drain of fossil energy and the requirement for countermeasures of global warming. As for the noise generated by the transformer, reduction of the noise has been further demanded as transformer installation is made in urban area.

SUMMARY OF THE INVENTION

An object of the present invention is to provide a grain-oriented electrical steel sheet with an extremely low core loss and a low noise and a method for producing the same. After diligent research by the inventors of the present invention, it is found that the product and the method can be accomplished by controlling the thickness of the solidified layer which is formed by laser irradiation onto the grain-oriented electrical steel sheet and controlling the surface roughness and cross section shape of the laser irradiated portion.

Gist of the present invention is as follows.

(1) Grain-oriented electrical steel sheet capable of excellent core loss and magnetostriction in a high flux density of 1.9 T, comprising a refined magnetic domain and a laser irradiated portion which has a solidified layer, wherein a thickness of the solidified layer in the laser irradiated portion is 4 μm or less.

(2) Grain-oriented electrical steel sheet capable of excellent core loss and magnetostriction in a high flux density of 1.9 T, comprising a refined magnetic domain and a laser irradiated portion which has a solidified layer, wherein a surface roughness Rz of the solidified layer in the laser irradiated portion along the rolling direction of the sheet is 4 μm or less.

(3) Grain-oriented electrical steel sheet according to item 1 or 2, wherein the laser irradiated portion is in the form of a continuous or dotted line and a cross section of the laser irradiated portion viewed from the transverse direction has a concave portion having a width of 200 μm or less and a depth of 10 μm or less.

(4) The grain-oriented electrical steel sheet according to item 1 or 2, wherein a distance between adjacent continuous or dotted lines on the steel sheet is less than 30 mm.

(5) The grain-oriented electrical steel sheet according to item 4, wherein the distance between adjacent continuous or dotted lines on the steel sheet is 3-5 mm.

(6) The grain-oriented electrical steel sheet according to item 3, wherein the width of the concave portion is 30-180 μm and the depth of the concave portion is 1-4 μm.

(7) Method for producing a grain-oriented electrical steel sheet capable of excellent core loss and magnetostriction in a high flux density of 1.9 T, comprising a step of performing laser irradiation to form a solidified layer so that a thickness of the solidified layer is 4 μm or less.

(8) Method for producing a grain-oriented electrical steel sheet capable of excellent core loss and magnetostriction in high flux density of 1.9 T, comprising a step of; performing laser irradiation in the form of a continuous or dotted line onto the grain-oriented electrical steel sheet to form a solidified layer so that a cross section of the solidified layer in the laser irradiated portion viewed from the transverse direction has a concave portion having a width of 200 μm or less and a depth of 10 μm or less, wherein a thickness of the solidified layer at a bottom of the concave portion is 4 μm or less.

(9) Method for producing a grain-oriented electrical steel sheet according to item 7 or 8, wherein a laser for laser irradiation is a fiber laser using a fiber having a core diameter of 500 μm or less.

(10) Method for producing a grain-oriented electrical steel sheet according to item 7 or 8, wherein a laser for laser irradiation is a fiber laser comprising a fiber having a core diameter of 200 μm or less.

(11) The method for producing a grain-oriented electrical steel sheet according to item 7 or 8, wherein a distance between adjacent continuous or dotted lines on the steel sheet is less than 30 mm.

(12) The method for producing a grain-oriented electrical steel sheet according to item 11, wherein the distance between adjacent continuous or dotted lines on the steel sheet is 3-5 mm.

(13) The method for producing a grain-oriented electrical steel sheet according to item 7 or 8, wherein the width of the concave portion is 30-180 μm and the depth of the concave portion is 1-4 μm.

This invention can reduce both core loss and magnetostriction of grain-oriented electrical steel sheet.

DETAILED DESCRIPTION OF THE INVENTION

Figure 1:
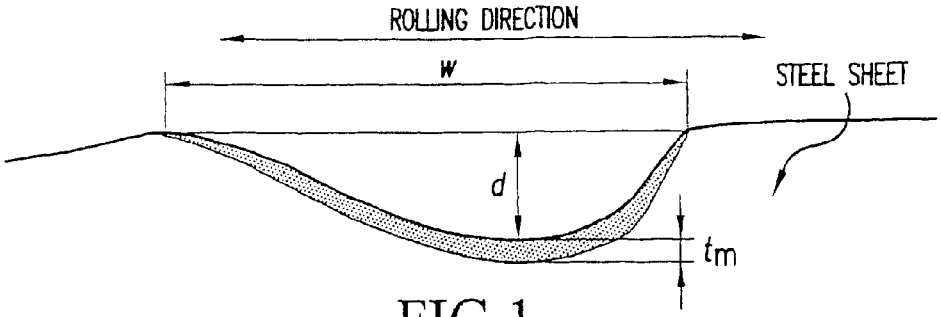
FIG. 1 is a schematic diagram illustrating a laser irradiated portion.

The laser irradiation is performed in the form of a line using a fiber-laser device, wherein the fiber has a fiber diameter of 10 μm, onto a surface of a fully-processed grain-oriented electrical steel sheet containing 3.3% of Si by mass and a thickness of 0.23 mm, in the near transverse direction (in-plane direction perpendicular to the rolling direction). A distance between the adjacent laser irradiation lines is 4 mm. The length of the laser irradiated portion in the rolling direction is varied from 50 μm to 200 μm. A concave shape of cross section and a solidified layer thickness viewed in the transverse direction (as e.g. shown in FIG. 1) are changed by varying such laser irradiation conditions as the laser irradiation beam spot diameter, laser power, the power density and the scan rate. As for preparing comparison samples, $CO_2$ laser and YAG laser are used. TABLE 1 shows the magnetic data of each sample. The core loss, the flux density and the magnetostriction are measured under the condition of sinusoidal magnetic flux without applying a load stress to the steel sheet. TABLE 1 indicates that samples (1), (2), (4) and (5) are superior to other samples in terms of both core loss $W_{19/50}$ and magnetostriction λ19p-p at a high magnetic field such as one having of a magnetization flux density of 1.9 T.

TABLE 1

| sample | width of concave portion (μm) | depth of concave portion (μm) | thickness of solidified layer (μm) | core loss W19/50 (W/Kg) | magneto-striction λ19p-p | remarks |
|---|---|---|---|---|---|---|
| (1) | 30 | 4 | 0.9 | 1.25 | $0.2 \times 10^{-6}$ | invention |
| (2) | 50 | 4 | 0.8 | 1.26 | $0.3 \times 10^{-6}$ | invention |
| (3) | 50 | 4 | 4.4 | 1.48 | $1.2 \times 10^{-6}$ | comparison |
| (4) | 90 | 3 | 0.8 | 1.28 | $0.4 \times 10^{-6}$ | invention |
| (5) | 160 | 2 | 1.7 | 1.36 | $0.3 \times 10^{-6}$ | invention |
| (6) | 280 | 2 | 4.7 | 1.45 | $0.8 \times 10^{-6}$ | comparison ($CO_2$) |
| (7) | 180 | 2 | 4.2 | 1.35 | $0.5 \times 10^{-6}$ | comparison (YAG) |

The inventors considered the reason why both a low core loss and a low magnetostriction at a high magnetic field such as one having a magnetization flux density of 1.9 T can be accomplished as follows. The mechanism for refining the domain to reduce the core loss is driven by the phenomenon wherein the total volume of the high-energy closure domain, which is formed by residual strain (thermal strain or impact strain by plasma reaction force) introduced by laser irradiation, tends to be reduced as shown, for example, in the Journal of The Magnetic Society of Japan, Vol. 25, No. 12, P1612.

As a result of laser irradiation under a variety of conditions described above, the inventors find that a great reduction effect of core loss can be obtained by controlling the thickness of the solidified layer and further the shape of concave portion of the cross section as described in the present invention. It is considered that this is because an appropriate amount of residual strain is introduced into a narrow area by controlling the thickness of the solidified layer, and width and depth of the concave portion, which leads to reducing the total volume of the closure domain. The effect is particularly significant with respect to the core loss at a high magnetic flux density. In the case of low magnetization flux density, the entire volume of the electrical steel sheet is partially magnetized and the change of the magnetized state of the closure domain occurs only partially through domain wall moving. In the case of high magnetization flux density such as 1.9 T, which is close to the saturation magnetic flux density, most of the closure domains change to those magnetized in the rolling direction, and this change causes the core loss. Therefore, the control of the thickness of the solidified layer is very effective in reducing the core loss in high magnetic flux density.

Figure 5:
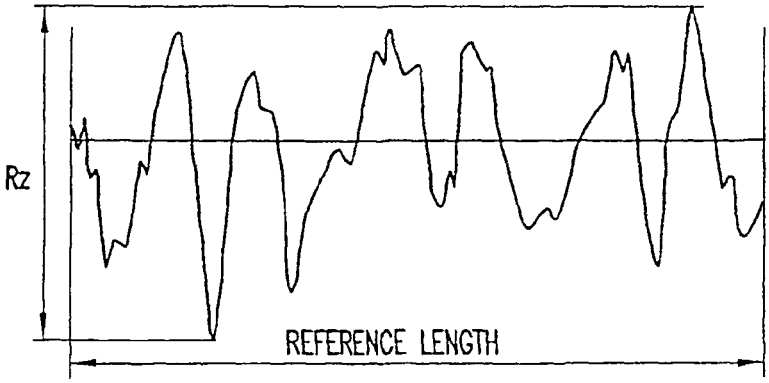
FIG. 5 shows definition of surface roughness Rz.

The solidified layer in this invention is a very fine solidified structure different from a monocrystal structure of the grain-oriented electrical steel sheet, which can be viewed when the cross section of the steel sheet in the rolling direction is observed using SEM or the like. This observation can be performed by such as, but not limited to, SEM (scanning electron microscope) together with etching, SEM using reflection electron image, FE-SEM (field emission SEM) or optical microscope. In order to change the thickness of the solidified layer, it is effective to change the laser irradiation beam spot diameter, the laser power, the power density and/or the scan rate. In FIG. 5 of JP2005-59014A, a laser irradiated portion where a solidified layer thickness is over 20 μm is disclosed. The invention disclosed in this patent publication is, as described in the paragraph [0003] of the publication, for reducing a core loss of grain-oriented electrical steel sheets where the effect of core loss reduction remains even after stress relief annealing. This is distinct from the object of the present invention, which is for providing low core loss grain-oriented electrical steel sheet used for iron cores that are not to be subjected to stress relief annealing such as an iron core for large-sized transformer. Accordingly, the technological concept is different from each other. If the condition where the solidified layer thickness is more than 20 μm as shown in FIG. 5 of JP2005-59014A is used in the present invention, the core loss becomes worse. WO2004/083465A1 discloses re-solidified layer formed with a fiber laser in FIG. 6(*b*). However, the thickness of re-solidified layer in the laser irradiated portion is about 6 μm, which does not meet the requirement of the present invention.

The residual strain introduced into the narrow area in the rolling direction can also reduce the magnetostrictive deformation, which causes noise from the iron core used for example for transformers as well as core loss. Although the residual strain introduced by the laser (in the concave portion as viewed from the transverse direction) is effective for refining domain width by forming a closure domain as mentioned above, if the area where the residual strain introduced is large, it could also be a source of magnetostrictive deformation. In view of this, it is important to form the residual strain so that the closure domain can be formed effectively and still remains localized. In this invention, the average thickness of the solidified layer is arranged to be 4 μm or less so that both a low core loss and a reduction of magnetostriction λ19p-p in such a high magnetic field can be accomplished.

In this invention, the reduction of core loss and magnetostriction can also be accomplished by reducing the surface roughness of bottom surface of a concave portion formed by laser irradiation as described below. The laser irradiation is carried out in the form of a line using a fiber-laser device having a fiber diameter of 10 μm, onto a surface of grain-oriented electrical steel sheet containing 3.3% of Si by mass and a thickness of 0.27 mm, in the transverse direction. A distance between adjacent laser irradiation lines is 4 mm. The length of the laser irradiated portion in the rolling direction is (1) 50 μm, (2)100 μm or (3)200 μm. A YAG laser is also used for carrying out the irradiation in the form of a dotted line onto the same grain-oriented electrical steel sheet. A distance between adjacent laser irradiation lines is 4 mm and the maximum length of laser irradiated portion in the rolling direction (corresponding to laser irradiation diameter) is (4) 100 μm and (5) 200 μm.

TABLE 2 shows the results of measurement of the surface roughness Rz at laser irradiated portions and their magnetic properties. The surface roughness Rz represents an index indicating the maximum height of the outer line as defined by ISO4287 (1997) and shown in FIG. 5. The surface roughness Rz of the laser irradiated potion is measured using an ordinary surface roughness tester. For measuring, the sensing pin scans the surface of the irradiated portion to cross the centerline of laser-irradiated portion in the rolling direction. As a result, it is found that there is a close correlation between the surface roughness Rz, the core loss and the magnetostriction. The measurement of surface roughness Rz is performed after cleaning the surface and the average value is calculated by averaging more than 10 measurement data after eliminating abnormal data. As for measurement of surface roughness Rz, it is the best to measure after removing the high tension insulating film and ceramic film on the surface of the steel sheet using alkali. However, some acid which is not strongly mordant to the steel sheet can be used for removing the film without changing a surface profile from a practical perspective. The core loss, magnetic flux and magnetostriction are measured respectively while being exposed to a sinusoidal magnetic flux without applying a load stress to the steel sheet.

TABLE 2

| sample | width of concave portion (μm) | depth of concave portion (μm) | Rz (μm) | thickness of solidified layer (μm) | core loss W19/50 (W/kg) | magneto-striction λ19p-p | remarks |
|---|---|---|---|---|---|---|---|
| (1) | 30 | 5 | 0.8 | 2.8 | 1.33 | $0.4 \times 10^{-6}$ | invention |
| (2) | 50 | 4 | 0.5 | 0.9 | 1.35 | $0.4 \times 10^{-6}$ | invention |
| (3) | 160 | 3 | 0.7 | 1.1 | 1.46 | $0.8 \times 10^{-6}$ | invention |
| (4) | 90 | 1 | 5.8 | 4.2 | 1.49 | $1.0 \times 10^{-6}$ | comparison |
| (5) | 190 | 1 | 5.2 | 4.7 | 1.46 | $0.9 \times 10^{-6}$ | comparison |

TABLE 2 indicates that the samples (1), (2) and (3) are superior to other samples in terms of both core loss and magnetostriction at a high magnetic field. As for samples (4) and (5) where a YAG laser is used, a pointed protrusion which seems to provide large surface roughness is observed, which is considered to cause core loss during high magnetic flux and magnetostriction becomes worse.

As for the reason why both a low core loss and a low magnetostriction under such a high magnetic field is obtained, it is considered that a leakage flux from pointed protrusions formed on the bottom of the laser irradiated portion can influence the reduction of core loss. Particularly core loss W19/50 under high flux density where the electrical steel sheet is almost in a magnetic saturation state is greatly influenced. In other words, in controlling the laser irradiation so that no portion with a large surface roughness is formed, the core loss in high flux density can be reduced.

PREFERRED EMBODIMENTS OF THE INVENTION

An ordinary grain-oriented electrical steel sheet product can be used for the present invention. Although steel sheets usually have a primary film of forsterite etc. and an insulate coating on the surface, the present invention can be applied to the steel sheet without such film or coating.

(Laser Conditions)

The length (width) of the laser irradiated portion in the rolling direction relates to the amount of closure domains which is formed by an elastic deformation caused by thermal strain around the irradiated portion, by reciprocal effect of magnetostriction. Closure domain is a source of domain refinement and leads to core loss reduction, however, it also can be a cause of magnetostriction deformation. Therefore an appropriate condition should be determined to satisfy the both properties. In order to reduce the magnetostriction, laser irradiation width in the rolling direction is preferably 200 μm or less, more preferably 180 μm or less, 140 μm or less, 120 μm or less, and further more preferably 10 μm or less. In order to reduce the core loss, the laser irradiation width is preferably 20 μm or more, more preferably 30 μm or more, and further preferably 50 μm or more.

The power of the laser irradiation beam per unit area, i.e., power density, is preferably as high as possible to perform refining of the domains effectively. If the power density is too high, however, thickness of the solidified layer becomes large. Therefore the power density is preferably 150 $KW/mm^2$ or less and more preferably 100 $KW/mm^2$ or less. If the power density is too low, thickness of the solidified layer becomes small. Therefore the power density is preferably 0.5 $KW/mm^2$ or more and more preferably 1 $KW/mm^2$ or more.

If the irradiation time of laser beam on the steel sheet, i.e., the duration of irradiation, is too long, the thickness of the solidified layer becomes too large. Therefore the continuous irradiation time is preferably 1 msec. or less and more preferably 0.3 msec. or less. If the duration of irradiation is too short, the thickness of the solidified layer becomes too small. Therefore the duration of irradiation is preferably 1 μsec. or more and more preferably 5 μsec. or more.

The product of the power density and the duration of irradiation is an important controlling factor of solidified layer thickness. The product value ranges preferably from 5 $mJ/mm^2$ to 500 $mJ/mm^2$, more preferably from 10 $mJ/mm^2$ to 300 $mJ/mm^2$.

(Laser)

It is preferable that beam spot diameter of high power laser beam is 200 μm or less in manufacturing electrical steel sheet of the present invention. A YAG laser beam, referred to as multi-mode, is poor in focusing performance, and it is very difficult for the YAG laser to have a focused beam with a diameter of 200 μm or less. A $CO_2$ laser, which also uses multi-mode oscillation and has a wavelength longer than the YAG laser, is also difficult to have a beam spot with a diameter of 200 μm or less. In order to obtain a highly concentrated single mode output from these lasers, a special device such as a spatial filter has to be installed in the laser resonator. In this case, however, the laser output is significantly reduced. Therefore, such lasers are not suitable for industrial mass production.

Meanwhile, a fiber laser can easily achieve a single mode oscillation of a highly concentrated beam. Also the fiber laser can easily achieve a high output beam by increasing the number of semiconductor lasers which are excitation light sources, and the length of the fiber. As it is possible to obtain a focused beam up to 40-50% of fiber core diameter using a rather simple lens system, a fiber laser easily leads to a small (200 μm or less) beam spot diameter. In view of this, a fiber laser having a fiber core of 500 μm or less is a preferred laser to be used for the manufacturing method of the present invention. If the fiber core diameter exceeds 500 μm, it is difficult to obtain a desired thickness of the solidified layer and the desired shape of the cross section. The diameter of the core is preferably 200 μm or less and more preferably 40 μm or less.

A multi-mode beam used in a YAG laser or the like is the beam formed by the superposition of various light intensity distributions. The beam may alter the mode of oscillation depending on changes in the temperature distribution of the laser medium in the cross section plane perpendicular to the laser output direction and/or of the excitation intensity. This causes control of solidified layer thickness of this invention to be unstable. The mode of the fiber laser, however, is the single mode regulated by fiber core diameter and has no unstable factor described above. Therefore a fiber laser is preferable in this invention for forming a consistent stable solidified layer.

Using the laser under the conditions described above, laser irradiation to the surface of grain-oriented electrical steel sheet is carried out. Laser irradiation can be carried out in the form of a line or dotted line in the sheet width direction. The sheet width direction, in this invention, includes direction within ±30 degrees of transverse direction. A distance between adjoining two laser irradiation lines (or dotted lines) in the rolling direction is preferably from 1 mm to 100 mm. The distance is more preferably less than 30 mm and further preferably 3 mm to 5 mm.

Figure 3:
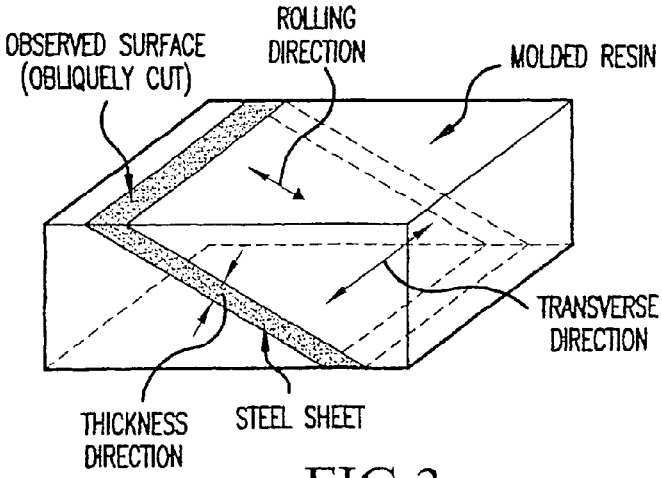
FIG. 3 shows a structure of a steel sheet sample prepared for the photograph of the cross section as in Photo (a) and Photo (b).
Figure 4:
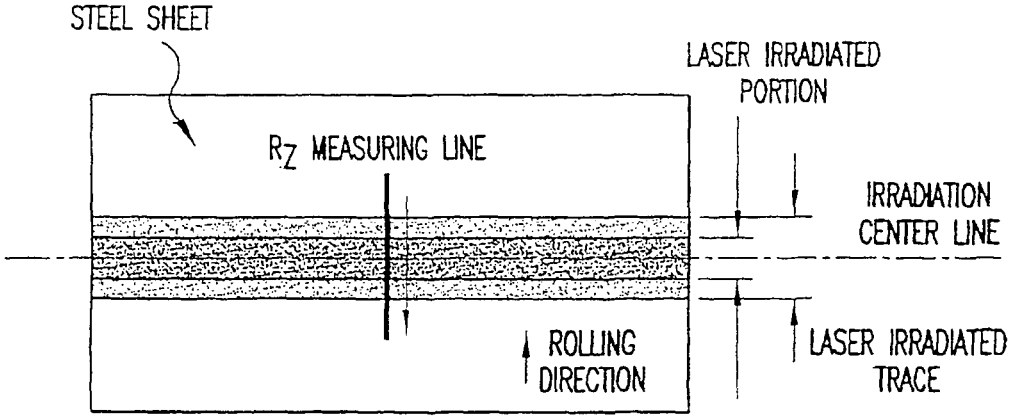
FIG. 4 is a schematic diagram illustrating how to measure surface roughness of laser irradiated portion.

The thickness of solidified layer formed in the laser irradiated portion should be 4 μm or less (shown as "$t_m$" in FIG. 1). The thickness of solidified layer is determined by measuring a length of solidified layer (in the sheet thickness direction) of the thickest portion of the solidified layer. The length of solidified layer at a position of the center of laser irradiated portion can be used as a representative value of the thickness of solidified layer, since the thickest portion usually corresponds to the center of laser irradiated portion. For obtaining a more accurate measure of the solidified layer thickness, it is preferable to average a plurality of thickness data measured in the area to be measured (e.g., ranging ±10 μm from the center line). Observation of the solidified layer can be performed by SEM together with etching, by SEM using a reflection electron image, by FE-SEM, or by optical microscope. The thickness of solidified layer can be more precisely measured by using an SEM photo of the sample prepared using oblique polishing as shown in FIG. 3. Maintaining the upper limit value of 4 μm for the solidified layer thickness helps to improve the reduction in core loss in high magnetic flux without deteriorating magnetostriction. As for the lower limit of solidified layer thickness, 0.1 μm is preferable in terms of securing thermal deformation volume which is necessary to hold elastic deformation for refining domain. More preferably, 0.5 μm to 2 μm of the solidified layer thickness is more preferable.

Figure 2:
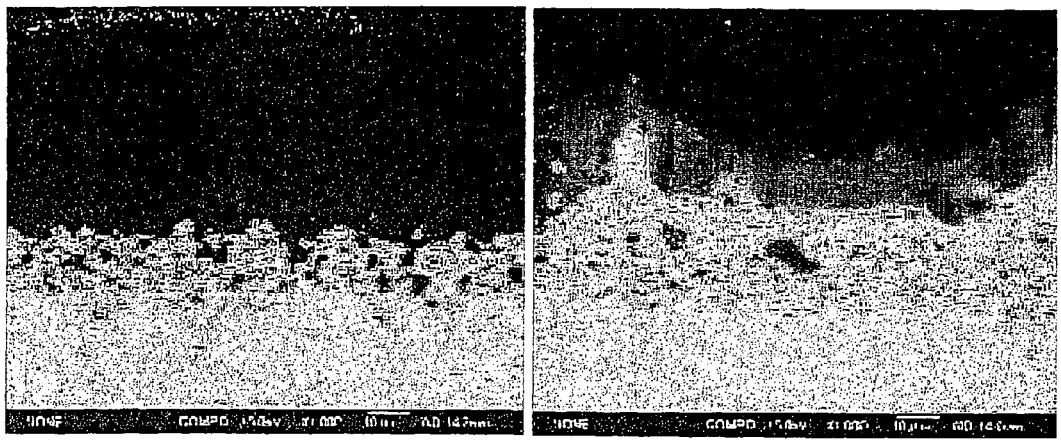
FIG. 2 contains photos showing a solidified layer structure of laser irradiated portion. Photo (a) shows an example of the present invention and Photo (b) shows a comparative example. The observed surface of the cross section has been obliquely cut and polished. Due to the oblique cutting, the length in the vertical direction of the photo is elongated to show 5 times the true length in the case of normally cut cross section.

FIG. 2 shows a solidified layer structure at laser irradiated portion (Photo (a): sample of the present invention, Photo (b): comparison sample). The sample of Photo (a) is prepared under the laser irradiation condition where a length of laser irradiated portion (width "W" in FIG. 1) in the rolling direction is 70 μm, power density is 3 kW/mm$^2$ and the sample of Photo (b) is prepared under the laser irradiation condition where a length of laser irradiated portion in the rolling direction is 250 μm, power density is 30 kW/mm$^2$. Irradiation beam scanning rate in the transverse direction is the same in both samples. Laser irradiation is carried out in the form of a continuous line in the transverse direction and a distance between two adjoining irradiation lines is 5 mm.

The power density is defined as (laser irradiation power on the steel sheet)/(area of laser irradiated portion on the steel sheet), i.e., power of laser irradiation per unit area of irradiated portion. The photos shown in FIG. 2 are obtained with respect to the test piece sample shown in FIG. 3. The observed (photo taken) cross section of the steel sheet is obliquely cut together with the molded resin therearound to secure the sample steel sheet. As a result of the oblique cutting, the vertical scale of the photos of FIG. 2 is enlarged by 5 times compared to a cross section to be observed if the sample sheet cutting is made in the normal direction (i.e., not oblique cutting). It is found that as for sample of Photo (a), the solidified layer thickness is 3.3 μm, the core loss W19/50(W/kg)=1.34 W/kg, and the magnetostriction $\lambda$19p-p=0.45×$10^{-6}$; and as for sample of Photo (b), the solidified layer thickness is 4.7 μm, the core loss W19/50(W/kg)=1.67 W/kg, and the magnetostriction $\lambda$19p-p=0.7×$10^{-6}$. Sample of Photo (a) of the present invention shows superior data of core loss in high magnetic flux and low magnetostriction. The thickness of the steel sheet of both samples is 0.27 mm.

As for a cross section of the sheet viewed from the transverse direction, the cross section preferably has a concave portion (recess) having a width of 200 μm or less and depth of 10 μm or less. The upper limit of the width is preferably 200 μm to avoid lowering a stacking factor and to keep both reduced core loss in high magnetic flux and low magnetostriction. The width is preferably 30 to 180 μm. The upper limit of the depth is preferably 10 μm to avoid lowering the stacking factor as well, to keep good core loss at high magnetic flux and to avoid deterioration of magnetic flux density. The depth is preferably 1 to 4 μm. FIG. 1 shows a schematic diagram of the concave portion in the laser irradiated portion viewed from a transverse direction. Symbol "$t_m$" represents maximum thickness of solidified layer, "d" represents depth of the concave portion and "W" represents width (in the rolling direction) of the concave portion.

An embodiment of the invention where the surface roughness of laser irradiated portion is small is described below. In the present invention, a refined magnetic domain is made by performing laser irradiation in the sheet width direction in the form of a line or dotted line onto grain-oriented electrical steel sheet. The sheet width direction, in this invention, includes directions within ±30 degrees of transverse direction. The form of a line means that the laser irradiation is performed so that the laser irradiation trace forms a continuous line. The form of a dotted line means that the laser irradiation is performed so that the laser irradiation forms individual oval or circular shapes arranged in a line. The laser irradiation trace does not have to form a straight line but can form a wavy line. In the case of a wavy line, the above-mentioned sheet width direction is defined based on a center line of the wavy line.

In this invention, it is preferable to use a fiber laser since the fiber laser is capable of reducing the bottom part size of the irradiation trace and lowering core loss under high magnetic flux. A YAG laser is also capable of reducing the size of an irradiation trace, but requires a large-scale apparatus to generate sufficient power in addition that the multi-mode oscillation has difficulty in reducing the surface roughness of the bottom surface of the laser irradiated portion. A $CO_2$ laser also has difficulty in reducing the size of irradiation trace, since the wave length is long and there is difficulty in reducing the roughness because of the multi-mode oscillation as well as YAG laser.

As for a fiber laser, it is preferable to use a fiber having a diameter of 500 μm or less because of the improved laser beam quality which leads to a simple compact optical system capable of reducing the size of the bottom part. Using a fiber with a diameter of more than 500 μm, makes it difficult to obtain a desired bottom part shape. It is preferable to use a fiber having a 200 μm or less diameter, more preferably 40 μm or less.

A "laser irradiated portion" means a portion where the surface of the steel sheet is partially melted when laser is irradiated. In the case of a grain-oriented electrical steel sheet having a ceramic film thereon, a portion, under the ceramic film, where the surface of the steel sheet is partially melted is defined as a laser irradiated portion. FIG. 2 shows photos of a cross section. The portion where the surface of the steel sheet is partially melted means a surface layer region which looks different from a lower homogeneous base metal portion. As for the width of a concave portion in the cross section viewed from the transverse direction, the width is preferably 30 μm or more, more preferably 50 μm or more, since too narrow a width may provide larger surface roughness. To determine the surface roughness Rz in this invention, it is preferable to average a plurality of roughness data measured at different positions in the area having a width in the rolling direction where the laser irradiated bottom part is included (e.g., area within laser irradiation width). Rz is preferably 4.0 μm or less, more preferably 3.5-3.0 μm or less, and further more preferably 2.5 μm or less.

Example 1

Laser irradiation is carried out in the form of a line using a fiber-laser device, having a fiber diameter of 10 μm, onto a surface of a fully-processed grain-oriented electrical steel sheet containing 3.2% of Si by mass, and a thickness of 0.23 mm, in about the transverse direction. A distance between adjoining two laser irradiation lines is 3 mm. The length of laser irradiated portion in the rolling direction is 30 μm. A thickness of solidified layer is varied by varying laser power and by varying laser scanning rate in the transverse direction. TABLE 3 shows magnetic data of each sample. The core loss, the flux density and the magnetostriction are measured while being exposed to a sinusoidal magnetic flux without applying a load stress to the steel sheet. TABLE 3 indicates the samples of (1) and (2) are superior to the comparison sample in terms of both reduced core loss and magnetostriction in a high magnetic field.

TABLE 3

| sample | thickness of solidified layer (μm) | core loss W19/50 (W/kg) | magnetostriction λ19p-p | remarks |
|---|---|---|---|---|
| (1) | 1.5 | 1.25 | $0.3 \times 10^{-6}$ | invention |
| (2) | 0.8 | 1.26 | $0.35 \times 10^{-6}$ | invention |
| (3) | 4.5 | 1.60 | $1.2 \times 10^{-6}$ | comparison |

Example 2

Laser irradiation is carried out in the form of a line using a fiber-laser device, having a fiber diameter of 10 μm, onto a surface of a fully-processed grain-oriented electrical steel sheet containing 3.3% of Si by mass, and a thickness of 0.23 mm, in about the transverse direction. A distance between adjoining two laser irradiation lines is 4 mm. As the length of laser irradiated portion in the rolling direction, (1) 30 μm, (2) 80 μm and (3) 250 μm are carried out. $CO_2$ laser irradiation is also carried out in the form of a line onto the same grain-oriented electrical steel sheet. A distance between adjoining two laser irradiation lines is 4 mm and the length of laser irradiated portion in the rolling direction is varied from (4) 300 μm and (5) 500 μm. The thickness of the solidified layer is controlled by varying laser power and irradiation time. TABLE 4 shows magnetic data of each sample. The core loss, the flux density and the magnetostriction are measured under the condition of sinusoidal magnetic flux without applying load stress to the steel sheet. TABLE 4 indicates the samples of (1), (2) and (3) are superior to other samples in terms of both core loss and magnetostriction in a high magnetic field.

TABLE 4

| sample | width of concave portion (μm) | depth of concave portion (μm) | thickness of solidified layer (μm) | core loss W19/50 (W/kg) | magneto-striction λ19p-p | remarks |
|---|---|---|---|---|---|---|
| (1) | 30 | 5 | 0.9 | 1.23 | $0.3 \times 10^{-6}$ | invention |
| (2) | 50 | 4 | 1.3 | 1.25 | $0.25 \times 10^{-6}$ | invention |
| (3) | 160 | 3 | 2.2 | 1.33 | $0.4 \times 10^{-6}$ | invention |
| (4) | 130 | 1 | 5.1 | 1.49 | $0.8 \times 10^{-6}$ | comparison |
| (5) | 300 | 1 | 4.2 | 1.46 | $0.6 \times 10^{-6}$ | comparison |

Example 3

Laser irradiation is carried out in the form of a line using a fiber-laser device having a fiber diameter of 20 μm, onto a surface of a fully-processed grain-oriented electrical steel sheet containing 3.2% of Si by mass, and a thickness of 0.27 mm, in about the transverse direction. A distance between adjoining two laser irradiation lines is 5 mm. A length of laser irradiated portion in the rolling direction is 50 μm. The occurrence of pointed protrusions in the laser irradiated portion is varied by varying the irradiation beam scanning speed in the transverse direction. TABLE 5 shows magnetic data and the shape of laser irradiated portion of each sample. The surface roughness of the laser irradiated potion is measured by scanning in the rolling direction using a stylus (sensing pin) type surface roughness tester. The core loss, the flux density and the magnetostriction are measured while being magnetized to a sinusoidal magnetic flux without applying a load stress to the steel sheet. TABLE 5 indicates the samples of (1) and (2) are superior to other samples in terms of both reduced core loss and magnetostriction in a high magnetic field.

TABLE 5

| sample | Rz (μm) | core loss W19/50 (W/kg) | magnetostriction λ19p-p | remarks |
|---|---|---|---|---|
| (1) | 1.2 | 1.36 | $0.35 \times 10^{-6}$ | invention |
| (2) | 1.7 | 1.33 | $0.4 \times 10^{-6}$ | invention |
| (3) | 5.2 | 1.65 | $1.3 \times 10^{-6}$ | comparison |

Example 4

Laser irradiation is carried out in the form of a line using a fiber-laser device having a fiber diameter of 10 μm, onto a surface of a fully-processed grain-oriented electrical steel sheet containing 3.3% of Si by mass, and a thickness of 0.23 mm, in about the transverse direction. A distance between adjoining two laser irradiation lines is 5 mm. The length of the laser irradiated portion in the rolling direction is varied from (1) 50 μm, (2) 100 μm and (3) 200 μm. $CO_2$ laser irradiation is also carried out in the form of a line onto the same grain-oriented electrical steel sheet. The distance between adjoining two laser irradiation lines is 5 mm, and the length of laser irradiated portion in the rolling direction is varied from (4) 200 μm and (5) 400 μm. TABLE 6 shows magnetic data and the shape of laser irradiated portion of each sample. The shape of laser irradiated portion is a concave portion of cross section viewed from the transverse direction. The core loss and the magnetostriction are measured while being magnetized to a sinusoidal magnetic flux without applying a load stress to the steel sheet. TABLE 6 indicates the samples of (1), (2) and (3) are superior to other samples in terms of both reduced core loss and magnetostriction in high a magnetic field.

TABLE 6

| sample | width of concave portion (μm) | depth of concave portion (μm) | Rz (μm) | thickness of solidified layer (μm) | core loss W19/50 (W/kg) | magneto-striction λ19p-p | remarks |
|---|---|---|---|---|---|---|---|
| (1) | 30 | 5 | 2.3 | 3.7 | 1.23 | $0.3 \times 10^{-6}$ | invention |
| (2) | 50 | 4 | 1.4 | 1.2 | 1.25 | $0.25 \times 10^{-6}$ | invention |
| (3) | 160 | 3 | 1.1 | 0.8 | 1.33 | $0.4 \times 10^{-6}$ | invention |
| (4) | 130 | 1 | 6.1 | 4.3 | 1.49 | $0.8 \times 10^{-6}$ | comparison |
| (5) | 300 | 1 | 5.2 | 4.1 | 1.46 | $0.6 \times 10^{-6}$ | comparison |
| (6) | 170 | 2 | 6.5 | 3.8 | 1.35 | $0.5 \times 10^{-6}$ | invention |

All references cited above, are herein incorporated by reference in their entirety.

The invention claimed is:

1. A grain-oriented electrical steel sheet, comprising a refined magnetic domain and a solidified layer formed by laser irradiation, wherein a thickness of the solidified layer is 4 μm or less and the solidified layer is in the form of a continuous or dotted line in a sheet width direction.

2. The grain-oriented electrical steel sheet according to claim 1, wherein cross section of the solidified layer viewed from the continuous or dotted line direction has a concave portion having a width of 200 μm or less and a depth of 10 μm or less.

3. The grain-oriented electrical steel sheet according to claim 1, wherein a distance between adjacent continuous or dotted lines on the steel sheet is less than 30 mm.

4. The grain-oriented electrical steel sheet according to claim 3, wherein the distance between adjacent continuous or dotted lines on the steel sheet is 3-5 mm.

5. The grain-oriented electrical steel sheet according to claim 2, wherein the width of the concave portion is 30-180 μm and the depth of the concave portion is 1-4 μm.

6. A method for producing a grain-oriented electrical steel sheet, comprising a step of performing laser irradiation to form a solidified layer in the form of a continuous or dotted line in a sheet width direction, so that a thickness of the solidified layer is 4 μm or less.

7. The method for producing a grain-oriented electrical steel sheet according to claim 6, wherein a laser for laser irradiation is a fiber laser having a fiber having a core diameter of 500 μm or less.

8. The method for producing a gain-oriented electrical steel sheet according to claim 6, wherein a laser for laser irradiation is a fiber laser comprising a fiber having a core diameter of 200 μm or less.

9. The method for producing a grain-oriented electrical steel sheet according to claim 6, wherein a distance between adjacent continuous or dotted lines on the steel sheet is less than 30 mm.

10. The method for producing a grain-oriented electrical steel sheet according to claim 9, wherein the distance between adjacent continuous or dotted lines on the steel sheet is 3-5 mm.

11. The method for producing a grain-oriented electrical steel sheet according to claim 6, wherein a cross section of the solidified layer viewed from the continuous or dotted line direction has a concave portion having a width of 200 μm or less and a depth of 10 μm or less.

12. The method for producing a grain-oriented electrical steel sheet according to claim 11, wherein the width of the concave portion is 30-180 μm and the depth of the concave portion is 1-4 μm.

* * * * *